US006839036B1

(12) United States Patent
Apostolos et al.

(10) Patent No.: US 6,839,036 B1
(45) Date of Patent: Jan. 4, 2005

(54) CONCATENATED VIVALDI NOTCH/ MEANDER LINE LOADED ANTENNAS

(75) Inventors: John T. Apostolos, Merrimack, NH (US); Roland A. Gilbert, Milford, MA (US)

(73) Assignee: BAE Systems Information and Electronic Systems Integration, Inc., Nashua, NH (US)

( * ) Notice: Subject to any disclaimer, the term of this patent is extended or adjusted under 35 U.S.C. 154(b) by 0 days.

(21) Appl. No.: 10/629,500

(22) Filed: Jul. 29, 2003

(51) Int. Cl.[7] ..... H01Q 13/10
(52) U.S. Cl. ..... 343/770; 343/767
(58) Field of Search ..... 343/725, 767, 343/770

(56) References Cited

U.S. PATENT DOCUMENTS 5,227,808 A * 7/1993 Davis ..... 343/915
5,268,701 A * 12/1993 Smith ..... 343/767
5,786,792 A * 7/1998 Bellus et al. ..... 343/770
5,790,080 A 8/1998 Apostolos
6,313,716 B1 11/2001 Apostolos
6,323,814 B1 11/2001 Apostolos
6,373,440 B2 4/2002 Apostolos
6,373,446 B2 4/2002 Apostolos
6,404,391 B1 6/2002 Apostolos
6,480,158 B2 11/2002 Apostolos
6,492,953 B2 12/2002 Apostolos
6,597,321 B2 * 7/2003 Thursby et al. ..... 343/744
6,630,909 B2 * 10/2003 Nepveu ..... 343/744
6,741,212 B2 * 5/2004 Kralovec et al. .... 343/700 MS

* cited by examiner

*Primary Examiner*—Tho Phan
(74) *Attorney, Agent, or Firm*—Daniel J. Long; Robert K. Tendler

(57) ABSTRACT

Combined Vivaldi notch and meander line loaded antennas are concatenated in an array to provide an ultra wideband antenna having a decreased low frequency cut-off due to the concatenation. In the concatenation process, plates of adjacent antennas are shared so that one plate is used for both of the adjacent antennas. In a preferred embodiment, the side plates and the top and bottom plates are identically configured.

25 Claims, 8 Drawing Sheets

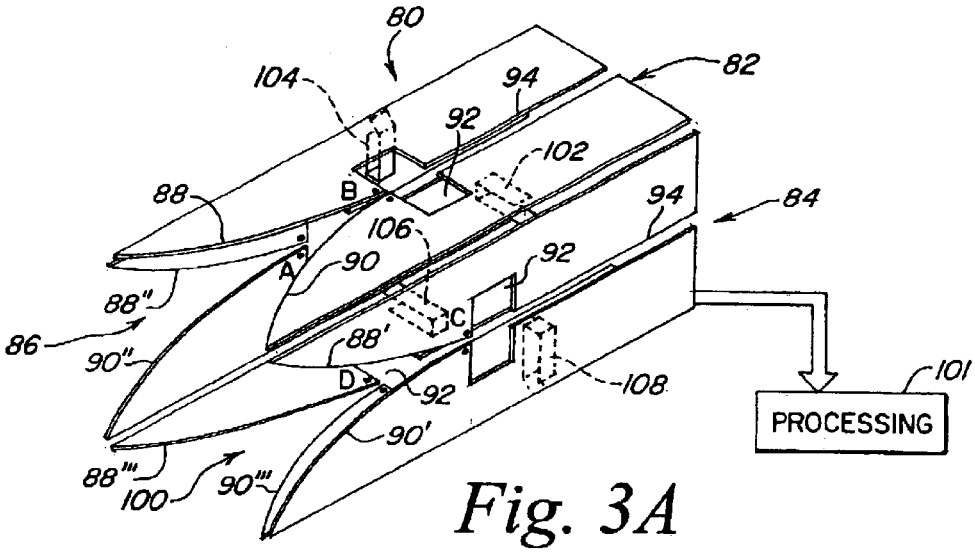
Fig. 3A
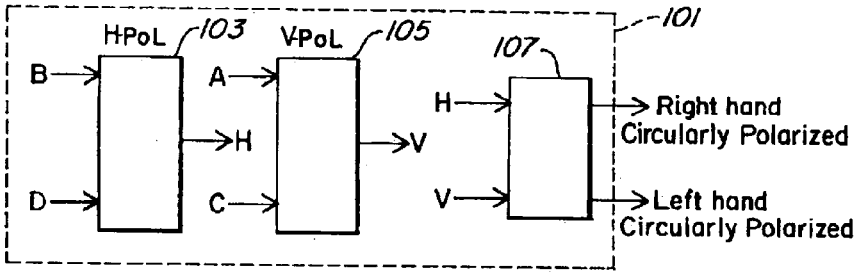
Fig. 3B
Mode Table
| | V-PoL | H-PoL | RH C-PoL | LH C-PoL |
|---|---|---|---|---|
| A | 1 | 0 | 1 | 1 |
| B | 0 | 1 | −i | +i |
| C | 1 | 0 | 1 | 1 |
| D | 0 | 1 | −i | +i |
Fig. 4

CONCATENATED VIVALDI NOTCH/ MEANDER LINE LOADED ANTENNAS

FIELD OF INVENTION

This invention relates to ultra wide bandwidth antennas, and more particularly to the concatenation of combined Vivaldi notch and meander line loaded antennas.

BACKGROUND OF THE INVENTION

As described in co-pending U.S. patent application Ser. No. 10/629,659 entitled "Dual Polarization Vivaldi Notch/ Meander Line Loaded Antenna" by John T. Apostolos, filed on even date herewith, and as described in patent application Ser. No. 10/629,454, entitled "Combined Ultra Wideband Vivaldi: Notch/Meander; Line Loaded Antenna" by John T. Apostolos, filed on even date herewith, both assigned to the assignee hereof and incorporated herein by reference, it is possible to provide an antenna element which is the combination of a Vivaldi notch and a meander line loaded antenna (MLA). These antennas in general have a top horizontal plate surrounded on two sides by downwardly depending plates which form side plates. The side plates are coupled to the horizontal plate through meander lines.

The purpose of providing such a combined Vivaldi notch antenna and meander line loaded antenna, is to take advantage of the high upper frequency cut-off of the Vivaldi notch antenna while establishing a minimized low frequency cut-off by utilizing the meander line loaded antenna configuration. As described in the above patent applications, the operation of these antennas provides continuous grating lobe-free coverage of, for instance, between 50 MHz and 1.5 GHz in a smooth transition between the high frequency cut-off and the low frequency cut-off. Moreover, the Vivaldi notch antennas are provided with a cavity which results in an end-fire configuration. It has been found that antennas combined in this manner produce a single lobe, and are of such a small size that they prevent grating lobes when the antenna elements are arrayed.

Moreover, when the Vivaldi notch, cavity, back facing slot structure is duplicated in the side plate % and a bottom plate to provide a square horn like structure, the antenna can be operated with a number of different switchable polarities, depending on which feed points are used. As a result, with an arrangement of a horn having a top plate, two side plates, and a bottom plate, and feed points at four locations, respectively at the throats of each of the Vivaldi notches, it is possible to provide a horizontal polarization, a vertical polarization, a right hand circular polarization, or a left hand circular polarization. Assuming that the feed points in such a structure are labeled A, B, C, and D, then the following mode table specifies how the various polarizations are established:

| | $V_{pol}$ | $H_{pol}$ | $RH_{Cpol}$ | $LH_{Cpol}$ |
|---|---|---|---|---|
| A | 1 | 0 | 1 | 1 |
| B | 0 | 1 | −i | +i |
| C | 1 | 0 | 1 | 1 |
| D | 0 | 1 | −i | +i |

The result of the inventions in the aforementioned two patent applications is that one can establish an ultra wideband antenna having a single lobe with switchable polarizations.

While the above configurations have a relatively low low frequency cut-off, one needs the opportunity to further decrease the low frequency cut-off down to for instance 20 MHz, so as to provide a super ultra wideband antenna whose operating frequency range goes from 20 MHz to 1.5 GHz and beyond when one can ignore grating lobes.

Such an antenna would be useful in ultra wideband communications and not only for currently authorized ultra wideband commercial applications, but also for military applications which extend from 20 MHz up to multiple gigahertz.

SUMMARY OF THE INVENTION

In order to decrease the low frequency cut-off of a Vivaldi notch meander line loaded antenna combination, in the subject invention the combined Vivaldi notch/meander line loaded antennas are concatenated, in one embodiment, by placing antennas side by side and electrically connecting them through the utilization of a common side plate. As a result, one side plate is shared by two adjacent antennas. What is accomplished by the concatenation is to in essence double the size of the antenna at the lower frequencies. Depending on how many side-by-side antennas are concatenated, the size of the overall array may be tripled or quadrupled. Another way to expand the size is to arrange a pair of concatenated antennas on top of another pair of concatenated antennas in a quad configuration. Here the bottom plates of the upper pair are shared and form the top plates of the bottom pair. With this quad configuration, the size is four times that of a single combined Vivaldi notch/ meander line loaded antenna. The reason that they can be considered four times the size is that they are all directly connected together, which is accomplished by using the meander lines themselves to make the connections.

What has been found is that at the low frequency end, assuming that one has two antennas which are concatenated, then these two elements act like one element so as to effectively lower the low frequency cut-off of the pair. As one goes higher in frequency, one transitions to a region in which these concatenated antenna elements act like separate elements. This has a particularly beneficial result because at higher frequencies, beam forming can be made to occur. Note that at the higher frequencies, one does not need larger element size since the low frequency cut-off is not an issue. The result that is at the higher frequencies, each of the elements operates independently, and since one doesn't need the extra volume to go lower at the higher frequencies, one gets the usual benefits of an array of antenna elements. While the elements themselves may be capable of a 30:1 bandwidth spread, if wants to go to a 100:1 bandwidth spread by decreasing low frequency cut-off, then one has to combine four elements. The combination of two elements results in a 50 or 60:1 spread, whereas the combination of two more elements permits the 100:1 spread due to the increased size of the overall antenna acting as a single antenna at the lower frequencies.

The result in the lower frequencies is that in one embodiment, one gets coverage down to as low as 20 MHz, whereas in the upper frequencies, one can steer the beam from the antenna elements since the antenna elements act independently. It will be appreciated that this antenna is scalable in frequency. One could scale the dimensions so as to move the operation of the antenna to different frequency bands.

Note that for a quad concatenation, one has twelve feed points. For: horizontal polarization, six feed points are combined, whereas for vertical polarization, six other feed points are combined. For right hand circular polarization or left hand circular polarization, the outputs of the six-way combiners for the horizontal and vertical polarizations are utilized in a 90° hybrid combiner, the outputs of which are the right hand circular polarized and the left hand circular polarized signals.

It has been found that by the above concatenation, not only is the low frequency cut-off decreased, the single lobe characteristic of a single combined Vivaldi notch/meander line loaded antenna is preserved for the lower frequencies, and steerable beams are formable at the upper frequencies. Note, the concatenation of the individual Vivaldi notch/meander line loaded antennas results in overall gain.

It will be appreciated that at the low end of the band, one is feeding the concatenated elements basically in phase, so that at the low frequencies, the concatenated antenna elements operate as one large antenna. The result is that while one may be steering the wave at low frequencies in the same direction, the lobes are so wide it simply doesn't matter.

In summary, combined Vivaldi notch and meander line loaded antennas are concatenated in an array to provide an ultra wideband antenna having a decreased low frequency cut-off due to the concatenation. In the concatenation process, plates of adjacent antennas are shared so that one plate is used for both of the adjacent antennas. In a preferred embodiment, the side plates and the top and bottom plates are identically configured.

BRIEF DESCRIPTION OF THE DRAWINGS

These and other features of the subject invention will be better understood in connection with the Detailed Description in conjunction with the Drawings of, which:

FIG. 3A is a diagrammatic illustration of the modification of the combined Vivaldi notch and meander line loaded antenna of FIG. 2 to permit switching between dual polarizations through the selective application of different feeds to the feed points thereof, indicating a square horn configuration;

FIG. 3B is a block diagram of the processing unit of FIG. 3A showing the generation of the various polarizations;

FIG. 4 is a mode table indicating the signals applied to the various feed points of the antenna of FIG. 3A, indicating the ability to switch from vertical polarization, to horizontal polarization, to right hand circular polarization, and to left hand circular polarization;

DETAILED DESCRIPTION

Figure 1:
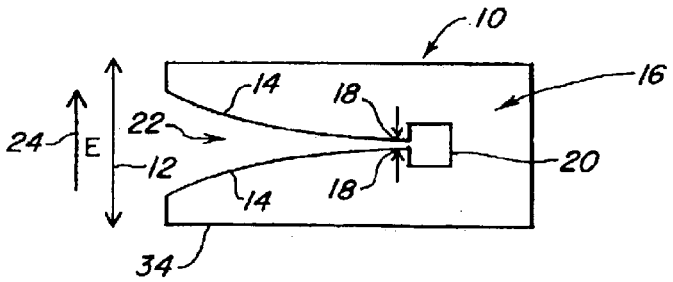
FIG. 1 is a diagrammatic view of a Vivaldi notch antenna illustrated as having exponentially curved notch edges as well as a rear cavity.

Before describing the subject invention what is now presented is a discussion relating to the combined Vivaldi notch and meander line loaded antennas, followed by a discussion of how the polarities of the antennas can be switched among vertically polarized, horizontally polarized, right hand circularly polarized, and left hand circularly polarized modes.

The Vivaldi Notch/Meander Line Loaded Antenna (MLA)

As described in the above noted applications, the combined Vivaldi notch/MLA antenna has a horizontal or linear polarization characteristic, which while exceedingly useful in horizontally polarized antenna scenarios, is not as effective as it might be when dealing with circularly polarized applications.

As will be appreciated, there has long been a requirement for a very wideband array antenna to cover, for instance, a band of 100:1 or even 300:1. The purpose of such an antenna is for any ultra wideband application in which one seeks to have a single lobe from the antenna array uncorrupted by so called grating lobes which are the spurious lobes that are the result of element spacings greater than 0.5 wavelength.

An array of bow tie elements suffers from grating lobes introduced by the many periods of oscillation in the element itself, and by the resulting large lattice spacing of the elements.

In order to eliminate the generation of multiple lobes, one would need some sort of traveling wave antenna with a width less than 0.5 wavelength at the highest frequency.

One such traveling wave antenna is a Vivaldi notch antenna. The Vivaldi notch antennas are those which have exponentially tapered notches which open outwardly from a feed at the throat of the notch. Typically, in such a Vivaldi notch antenna there is an open cavity behind the feed point which helps to match the feed impedance at the feed point and prevents energy from flowing back away from the feed point to the back end of the Vivaldi notch. As a result, in these antennas, one obtains radiation in the forward direction and obtains a single lobe beam over a 10:1 frequency range. One can obtain a VSWR less than 3:1 with the beams staying fairly constant over the entire antenna bandwidth with the lobe having about an 80° or 90° beam width.

As can be seen, the Vivaldi notch antennas are single lobe antennas which have a very wide bandwidth and are unidirectional in that the beam remains relatively constant as a single lobe over a 10:1 bandwidth both in elevation and in azimuth.

Note that a constant beam width is maintained because at high frequencies at the throat of the notch only a small area radiates. As one goes lower and lower in frequency, the wider parts of the notch are responsible for the radiating. As a result, the beam width tends to remain constant and presents itself as a single lobe.

The Vivaldi notch antennas were first described in a monograph entitled The Vivaldi Aerial by P. G. Gibson of the Phillips Research Laboratories, Redhill, Surrey, England in 1978 and by Ramakrishna Janaswamy and Daniel H. Schaubert in IEEE Transactions on Antennas and Propagation, vol. AP-35, no. 1, September 1987. The above article describes the Vivaldi aerial as a new member of the class of aperiodic continuously scaled antenna structures which has a theoretically unlimited instantaneous frequency bandwidth. This antenna was said to have significant gain and linear polarization that can be made to conform to constant gain versus frequency performance. One reported Gibson design had been made with approximately 10 dB gain and a minus −20 dB side lobe level over an instantaneous frequency bandwidth extending from below 2 GHz to about 40 GHz.

One Vivaldi notch antenna is described in U.S. Pat. No. 4,853,704 issued Aug. 1, 1989 to Leopold J. Diaz, Daniel B. McKenna, and Todd A. Pett. The Vivaldi notch has been utilized in micro strip antennas for some time and is utilized primarily in the SHF band and higher bands of the electromagnetic spectrum as a wide bandwidth antenna element.

The problem with Vivaldi notch antennas is that at low frequencies, the notch becomes a short circuit. If one attempts to feed a short circuit at low frequencies, one obtains no output.

There is therefore a necessity for providing an array antenna element which has the favorable characteristics of the Vivaldi notch antennas, yet is able to be made to operate at much lower frequencies.

The problem, however, with making these antennas operate at much lower frequencies, is that as one goes lower in frequency, the antenna elements-themselves become larger. When one attempts to array these elements, since the array elements are larger, their separation often exceeds a 0.5 wavelength. Separations over a 0:5 wavelength result in unwanted multiple lobes called-grating lobes.

It has been found that if one wants to avoid grating lobes, then the spacing between the antenna elements must be less than a 0.5 wavelength. It is therefore important to be able to fabricate an antenna with exceedingly small antenna elements so as to avoid the unwanted grating lobes while offering wideband performance.

In order to obtain an ultra wideband antenna element for use in an array, an antenna can be configured in a small package when the Vivaldi notch antenna is combined with a meander line loaded antenna structure such that for higher frequencies, the Vivaldi notch dominates, whereas for the lower frequencies, the meander line loaded antenna functioning as a dipole provides a wide bandwidth low end for the antenna element. Because the meander line loaded structure does not change the relatively small Vivaldi element size, this combination can be arrayed without producing grating lobes.

In order to form the dipole necessary for the meander line loaded antenna, the Vivaldi notch antenna rather than being provided with a closed end cavity, is provided with the rear end of the cavity opened up with a rearward slot so that at the lower frequency range, the antenna element starts to look like a dipole. Since the feed point is no longer shorted out at the lower frequencies, the result is that one has a fairly fat dipole. The problem with such an arrangement is how to make the dipole work over a 10:1 frequency range of its own accord.

In order to do so, one electrically connects adjacent Vivaldi elements to the center element through the meander line structure to make the dipole work over a wide bandwidth. This cancels out reactances at the low end of the frequency range. Such operation is described in U.S. patent application Ser. No. 10/123,787 filed Apr. 16, 2002 by John T. Apostolos entitled "Method and Apparatus for Reducing the Low Frequency Cut-off of a Meander Line Loaded Antenna", assigned to the assignee hereof and incorporated herein by reference.

In one embodiment, the above described antenna is provided with a Vivaldi notch in an upper plate which is bifurcated down its length. Two side plates vertically depend downwardly from respective top plates and are spaced from the top plates at either edge. The side plates are coupled to the top plate through a meander line structure, the purpose of which is to cancel reactances. The result is an overall ultra wideband structure that is small. When this structure is arrayed, the resulting structure does not violate the restriction that the spacing between the elements not be greater than 0.5 wavelength at the highest frequency. This means that the arrayed antenna elements will exhibit no grating lobes across the entire ultra wideband range, and results in an ultra wideband single lobe antenna array.

It has been found that by combining the two technologies, namely the Vivaldi notch antenna and the meander line technology, at the high frequency the Vivaldi notch is the active radiator, which doesn't see the meander line at all. At the higher frequencies, the gap on the top plate is not seen, and the Vivaldi notch works as it would work normally at the higher frequencies.

As the operating frequency gets lower and lower, the dipole begins to come into play, and the Vivaldi notch becomes less prominent. There is a transition region in which the notch and the dipole are now equally radiating coherently. However, as one goes lower in frequency, the notch stops radiating and is not seen, and one simply is left with the dipole augmented with the meander line structure.

The meander line structure is utilized to give the dipole the increased bandwidth by increasing the radiation resistance and reducing the reactances at the low end of the frequency band. This gives an exceptionally good match down to the very low frequencies.

It has been found that the performance in the frequency transition region between the Vivaldi notch and the meander line loaded antenna is smooth, and that there is no discontinuity in impedance or gain. The result is that one can provide an antenna that works over a 50:1 frequency range.

When one seeks to put these elements in an array, due to their size the separation of the elements in the array lattice is not more than a 0.5 wavelength at the highest frequency, thus eliminating the possibility of creating grating lobes. If the spacing were for instance to become more on the order of a wavelength, one would obtain the undesirable multi-lobe pattern.

It has been found that the combined Vivaldi notch/meander line loaded antenna when arrayed can work over a range of 50 MHz and 1500 MHz. Note that the spacing of the elements is less than a 0.5 wavelength at the highest frequency. As one goes down to $1/50^{th}$ of the highest frequency, then the 0.5 wavelength divided by 50 is 0.01 wavelengths at the low end of the frequency spectrum for the element. Thus for low frequencies, the spacing requirement is overly met, whereas at the highest frequencies the spacing requirement is just met.

It will be appreciated that for an efficient radiator, it is the volume of the structure which counts. Even though the element at the lowest frequency is very narrow, one nonetheless obtains effective volume in the longitudinal direction or axis of the antenna element.

When the antenna elements are arrayed, one also obtains height and depth so that the total volume is such that it is still efficient at the low end of the frequency spectrum, even though its lateral dimension is 0.01 wavelengths in width.

It will be appreciated that that the utilization of the Vivaldi notch along with the meander line loaded antenna configuration means that the elements are so small in the width direction that when the elements are arrayed, grating lobes are prevented from being generated.

If one were going to use some other technology in order to work over a frequency range of 100:1, one could presumably use bow tie structures. However, at the lowest frequency of operation of a bow tie, one would have at least $1/10^{th}$ of a wavelength which means that if one wanted to go up to 100:1 in frequency, then the structure at the high frequency would be 10 wavelengths long, resulting in a severe multi-lobe pattern.

It has been found that the only other antenna element that could work is the meander line itself, but the meander line itself only works over a frequency range of approximately 5–7:1. It does not achieve the 100:1 frequency range that is required. Absent combining with a Vivaldi notch and merely using meander line structures will not yield an ultra wideband result.

Providing a single lobe ultra wideband antenna is useful in ultra wideband authorization for wireless as well as other applications. In these applications, one does not want to have spurious side lobes or multiple lobes. Ultra wideband applications such as for instance covert communications, high data rate communications, burst communications, through-the-wall communications, ground-penetrating radar, and others, involve the sweeping of a frequency of, for instance, between 1.5 GHz and 100 GHz.

Using the above combination, one is now able with the combined Vivaldi notch and meander line structure to achieve an ultra wideband result. When arrayed, these antenna elements can be made to have a single lobe characteristic. One can therefore provide an antenna array whose elements are compact and whose spacing between the elements is less than a 0.5 wavelength.

Switchable Polarization

While the Vivaldi notch portion of the antenna described above lies essentially in one plane and has an E-field parallel to that plane thus to make it linearly polarized in the horizontal direction, it is often times desirable to be able to provide a vertically-polarized antenna or one which has a right hand or left hand circular polarization. Then if a transmission is either right hand circularly polarized or left hand circularly polarized, it is desirable to match this polarization to the receiving antenna and vice versa.

If trying to communicate with a land vehicle with a whip antenna or a cell phone, the antenna used is typically vertically polarized. Aircraft or unmanned airborne vehicles typically use horizontal polarization. Circular polarization is typical of satellite communications. Also, radars are typically switchable between linear and circular polarizations. Moreover, polarization diversity is used to keep bit error rates low or to increase the quality of communications. Having the polarization of an antenna switchable is thus beneficial.

In order to provide the ability to switch from a linearly polarized to a circularly polarized Vivaldi notch/meander line loaded antenna, and vice versa, in a combined Vivaldi notch/MLA antenna, the top Vivaldi notch/meander line loaded antenna structure which is intended to have side plates, has its Vivaldi notch structure duplicated in the side plates as well as being duplicated in a bottom plate such that the antenna in essence looks like a square horn in cross section, with the side plates connected to associated Vivaldi notch bearing plates by meander lines.

In one embodiment, a meander line connects a top plate to an orthogonal adjacent side plate bearing the Vivaldi notch structure. This is duplicated for all four sides of the horn, with the feed points for each of the four Vivaldi notches being fed in such a fashion that one can establish a vertical polarization, a horizontal polarization, a right hand circular polarization, or a left hand circular polarization.

As will be seen, when these square horn shaped elements are placed side by side in an array and are concatenated, the arraying itself of the elements increases the bandwidth capabilities of the array.

In a transmitting scenario, for vertical polarization, the feed points for the top and bottom are driven in-phase, whereas the side plates remain undriven. For a horizontal polarization, the opposed side plates are driven in-phase, with the top and bottom plates being undriven. For right hand circular polarization and left hand circular polarization, the opposed side plates are driven in-phase, whereas the opposed top and bottom plate feeds are driven with a −90° phase shift for right hand polarization, and with a 90° phase shift for left hand circular polarization.

Generation of the appropriate feed signals is simply accomplished using a standard quadrature hybrid combiner coupled to linear combiner, or conversely in the receive mode by using a combination of the standard quadrature hybrid combiner with linear combiners, one can process the output signals from the antenna so as to give the antenna the selected polarization characteristic. Note that the cross-polarization is about half of the port isolation.

It will be appreciated that what is needed to provide the dual polarity is to change the rectangular solid side plate of a Vivaldi notch/MLA antenna and convert it into another Vivaldi notch/meander line loaded antenna by patterning the Vivaldi notch into the side plates. Thus what one has done is to utilize a second Vivaldi notched plate as a substitute for the side plate for the original antenna. It will be appreciated that the purpose of the side plate is to give the structure a dipole response, in which the meander line loaded antenna has both vertical and horizontal plates, with meander lines attached between the vertical and horizontal plates. The result is that in converting the vertical or side plates into a Vivaldi notch/MLA structure, one can obtain a three-dimensional device which when fed appropriately, can be provided with a right hand polarization characteristic, a left hand polarization characteristic, a horizontal polarization characteristic, or a vertical polarization characteristic.

As noted above, there is virtually no interaction between the separate Vivaldi notch/MLA antenna elements. When feeding the opposed side plates in-phase, and looking at the current induced in the top and bottom plates, terminated at 50 MHz, one finds almost no cross talk. Here the cross talk may be 20 dB down. With cross talk down 20 dB at 50 MHz, at the high end the cross talk may be more than 40 dB down.

The fact that cross talk is minimal is positive, because one always wants to have the antenna, lobes that are independent and orthogonal. As measured, it has been found that these lobes are in fact independent and orthogonal.

Before discussion of the concatenation process and referring now to FIG. 1, a discussion is presented of the design characteristics of an ultra wideband single lobe forward-firing Vivaldi notch/meander line loaded antenna.

Referring to FIG. 1, a Vivaldi notch waveguide antenna 10 is illustrated as having an aperture 12 which is formed by exponentially shaped edges 14 in a plate 16. The antenna has a pair of feed points 18 which are adjacent the region of closest approximation of edges 14. Behind the feed point is a cavity 20, the purpose of which is to reflect back any rearwardly projecting radiation out through the notch which is defined by edges 14. The notch is therefore established by these edges as notch 22. Note that the E-field for the Vivaldi notch antenna Figure is as illustrated by arrow 24.

As mentioned hereinbefore, it is a feature of the Vivaldi notch antenna that its upper frequency cut-off is virtually unlimited. Thus it is typical for the Vivaldi notch antennas to operate from for instance from 100 MHz up to 10–20 GHz.

While this wide bandwidth operation is desirable, in some instance, the low frequency cut-off of such a Vivaldi notch antenna is restricted due to the fact that as one descends lower and lower in frequency, the feed is looking into a dead short. The result is no effective radiated energy below 100 MHz.

Figure 2:
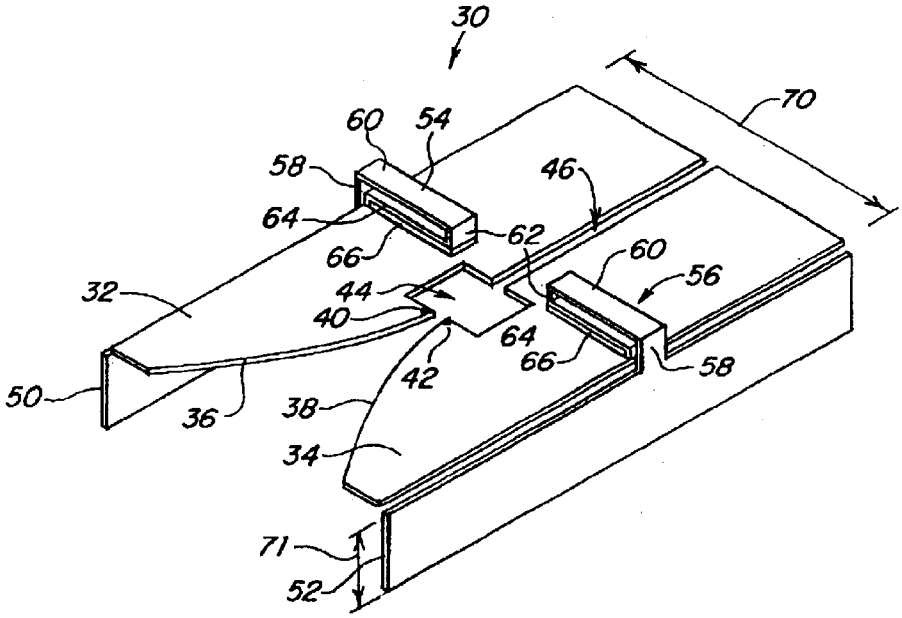
FIG. 2 is a diagrammatic illustration of a combination of a Vivaldi notch antenna and a meander line loaded antenna which exhibits a linear polarization characteristic.

In an effort to decrease the low frequency cut-off of the antenna FIG. 1, referring now to FIG. 2, a combined Vivaldi notch/meander line loaded antenna structure 30 is illustrated as having bifurcated top plates 32 and 34, with the top plates having exponentially shaped edges respectively at 36 and 38. The feed points 40 and 42 are at the points of closest approximation of edges 36 and 38, with a cavity 44 formed behind the feed points.

In an effort to lower the low frequency cut-off of the Vivaldi notch antenna, the top plate is bifurcated as illustrated so as to leave a slot 46 between the plates aft of cavity 44. What this does is to provide the opportunity for forming a dipole antenna having a low frequency cut-off much lower than that associated with the Vivaldi notch portion of the antenna.

In order to complete the meander line loaded proportion of the antenna, downwardly depending side plates 50 and 52 are coupled to associated top plates 32 and 34 through meander lines 54 and 56 respectively. Each of the meander lines has an upstanding portion 58, a laterally projecting portion 60, a downwardly depending portion 62, and a folded back portion-64 attached at its distal-end to an edge of plate 34, with the folded back portion being electrically insulated from the respective plate by an insulating layer 66.

Note that in one embodiment for a 50 MHz to 1500 MHz antenna the width 70 of the combination is 4 inches and the width 71 of the side plates is 4 inches.

It is the purpose of the meander line loaded structure to reduce the overall physical size of the dipole section of this antenna while at the same time decreasing the low frequency cut-off of this section by effectively adding length to the dipole and reducing its reactance. Thus, as the operating frequency of the antenna decreases, the reactance cancellation results in a VSWR of less than 3:1 down to, for instance in one embodiment, 50 MHz, and in some instances, down to 20 MHz to 30 MHz.

It has been found that the operation of the Vivaldi notch is not affected by the dipole portion of the antenna and as such the top or high frequency cut-off is unaltered by the meander line structure. On the other hand, it has been found that low frequency cut-off of the combined structure is that associated with the meander line loaded antenna portion.

Additionally, it has been found that the transition between low frequency and high frequency is smooth, and that there are no discontinuities in operation as one goes from a lower frequency to a higher frequency.

At the higher frequencies, it is the Vivaldi notch portion of the antenna which is active, whereas at the lower frequencies, it is the meander line loaded antenna dipole which is active.

Moreover, the width of the antenna as illustrated by double ended arrow 70 is indeed minimized by virtue of the meander line loaded antenna structure, it being noted that the meander line loaded structure is in general utilized to provide miniaturization for antennas by reducing the overall size of the antennas involved.

In terms of the antenna pattern from the antenna of FIG. 2, it is desirable to have a single lobe uncorrupted by multiple lobes when the antennas are arrayed. As mentioned hereinbefore, it is important that at the highest frequency of operation, the width 70 be no greater than 0.5 wavelengths. The width reduction due to the meander line loading antenna portion satisfies this requirement up to and including 1.5 GHz.

Referring now to FIG. 3A, what is now presented is the manner in which the antenna of FIG. 2 can be modified in order to provide a structure which enables switching between linear and circular polarizations.

Here a square cross-sectioned horn structure 80 has a top plate 82 which is identical to the plates 32 and 34 of FIG. 2. However, the side plates, rather than being of the type illustrated at 50 and 52 in FIG. 2, are configured themselves to carry a Vivaldi notch. Thus, side plate 84, which is duplicated on the other side at 86, is shown to have the same type of Vivaldi notch defined by edges 88 and 90 as are in top plate 82. Here these edges carry reference characters 88' and 90', with the edges in side plate 86 having an edge 88" and edge 90". Note that sides 84 and 86 are orthogonal to top plate 82 which, inter alia, has a cavity 92 and bifurcation slot 94 therein. This cavity and slot configuration is duplicated in the two side plates and in the bottom plate of the antenna now to be described.

It is noted that a bottom plate 100 is utilized to complete the horn structure, with the Vivaldi notch therein defined by edges 88'" and 90'".

For convenience, the feed points for side plate 86 are designated. A, for top plate 82 are designated B, for side plate 84 are designated C, and for bottom plate 100 are designated D. It is these feed points, when appropriately connected to a processor 101 that provide for a vertical polarization, a horizontal polarization, a right hand circular polarization, or a left hand circular polarization.

What will be apparent from looking at the square horn structure of FIG. 3A is that a Vivaldi notch/MLA structure is substituted for the usual side plate in a linearly polarized Vivaldi notch/MLA antenna. Moreover, what will be noticed is that meander line structures, here shown in dotted outline at 102, 104, and 208, couple the respective Vivaldi notch-bearing plates to their side plates. Note, the coupling between side plate 86 and bottom plate 100 is accomplished by meander line structure 106.

Referring to FIG. 31, processor 101 of FIG. 3A may include a linear combiner 103 having as inputs feed points B and D to provide a horizontal polarization for the antenna of FIG. 3A. As to vertical polarization, a linear combiner 105 has inputs from feed points A and C of the antenna of FIG. 3A, thus to give the antenna a vertical polarization characteristic. If one wants to provide the antenna with either a right hand circular polarized or a left hand circular polarized characteristic, then the outputs of combiners 103 and 105 are applied to a quadrature hybrid combiner 107 with the outputs thereof being right hand circularly polarized and left hand circularly polarized.

The processing of FIG. 3B is the processing for a receive mode, in which the antenna is given switchable polarization characteristics in accordance with the mode table of FIG. 4 to be described hereinafter. Note, however, that processing 101 can be operated in reverse to provide a switchable polarization characteristic for transmission, with the combiners operating in a bidirectional fashion, given the connections illustrated in the mode table.

Referring to FIG. 4, in the case of transmission, what can been seen from the mode table is that if one wishes to give the antenna of FIG. 3A a vertical polarization, then one couples combiner 101 to feed points A and C in-phase, and does not couple the combiner to points B and D at all. If one wishes to provide the antenna of FIG. 3A with a horizontal polarization, then one couples combiner 101 to points B and D and drives points B and D with in-phase signals, leaving feed points A and C devoid of input signals.

For a right hand circular polarized result, combiner 101 drives feed points A and C with in-phase signals, and drives feed points B and D with −90° out of phase signals, whereas for a left hand circular polarization result, one likewise drives feed points A and C with in-phase signals, but rather provides feed points B and D with +90° phase shifted input signals.

Concatenation

Figure 5:
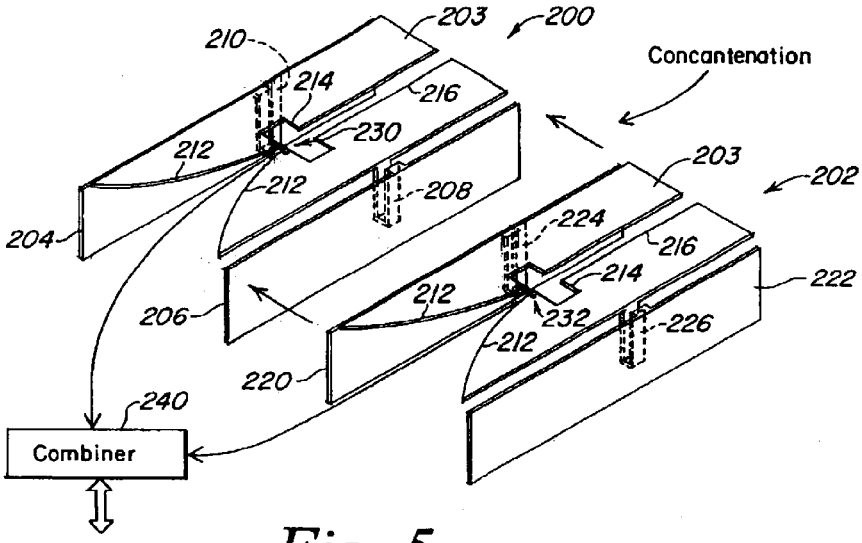
FIG. 5 is diagrammatic representation of the concatenation of two side-by-side combined Vivaldi notch/meander line loaded antennas, illustrating the side-by-side position of the antennas such that the right hand side plate of one antenna is shared as the left hand side plate of the adjacent antenna.

Referring to FIG. 5, concatenation of two horizontally disposed adjacent elements is provided for the purpose of decreasing the low frequency cut-off of the array by increasing the size of the array at low frequencies. Here a left hand combined Vivaldi notch/MLA element 200 is to be concatenated with a right hand element 202 of like configuration.

As will be seen, element 200 has a bifurcated top plate 203, side plates 204 and 206, and meander lines 208 and 210 which couple respectively side plates 206 and 204 to the bifurcated top plate. Each of the top plates includes exponentially shaped notch edges 212 and a cavity 214 at the throat of the notch, along with a slot 216 rearward of cavity 214.

Element 202 is like configured, having an identical top plate 203, a left side plate 220, and a right side plate 222. Side plate 220 is coupled to top plate 203 by a meander line 224, whereas side plate 222 is coupled to top plate 203 by meander line 226. As illustrated, the rest of the elements in top plate 203 are identical between elements 200 and 202.

The feed point for element 200 is illustrated at 230, whereas the feed point for element 203 is illustrated at 232.

In order to process the feed points either to address them or to couple them out, a combiner 240 is utilized. This combiner is a bidirectional combiner such that it may be used to provide a phasing of the array of these two elements either from a receive mode point of view or a transmit mode point of view.

Figure 6:
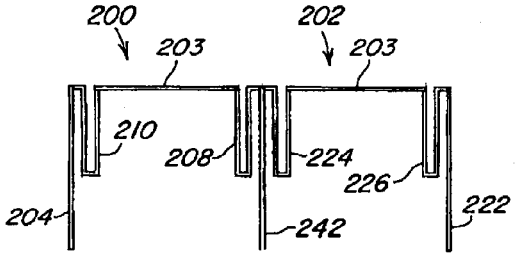
FIG. 6 is a cross-sectional view of the concatenated antennas of FIG. 5, illustrating a single sheet or plate used between the two antenna elements which are concatenated, also showing the utilization of meander lines to connect top plates to the shared side plate.

It is the purpose of the concatenation to provide, at least at the lower frequencies, a single antenna element having double the width of the single elements themselves. While it is possible merely to electrically attach side plate 206 to side plate 220, as shown in FIG. 6 one may use or substitute a single plate 242 for plates 206 and 220 of FIG. 5. The meander lines coupling together top plates 203 with adjacent side plates 204 and 220, are as illustrated, namely meander lines 210 and 224.

Figure 7:
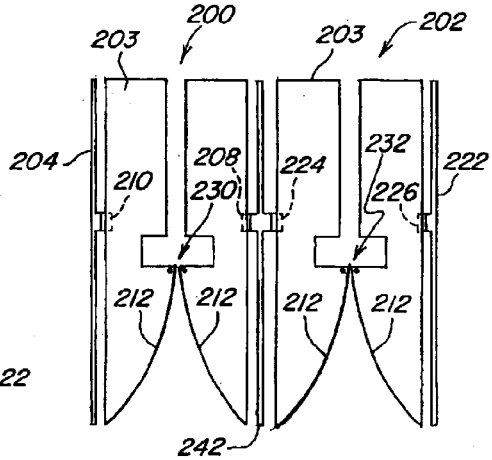
FIG. 7 is a top view of the concatenated antenna of FIG. 6, illustrating the single shared side plate.

Referring to FIG. 7, as can be seen the top view of the concatenated two elements, like elements have like reference characters with respect to FIGS. 5 and 6.

What will be appreciated is that plate 242 is shared by elements 200 and 202, such that the elements 200 and 202 are connected together.

The connection together of the two side-by-side elements at the lower frequencies produces a single element having a width which is twice that of the elements acting independently. As mentioned hereinbefore, the elements act independently at the higher frequencies, but at the lower frequencies, act as one element. This means that the low frequency cut-off of the concatenated elements may be decreased by the amount of increase of the width due to the concatenation.

Figure 8:
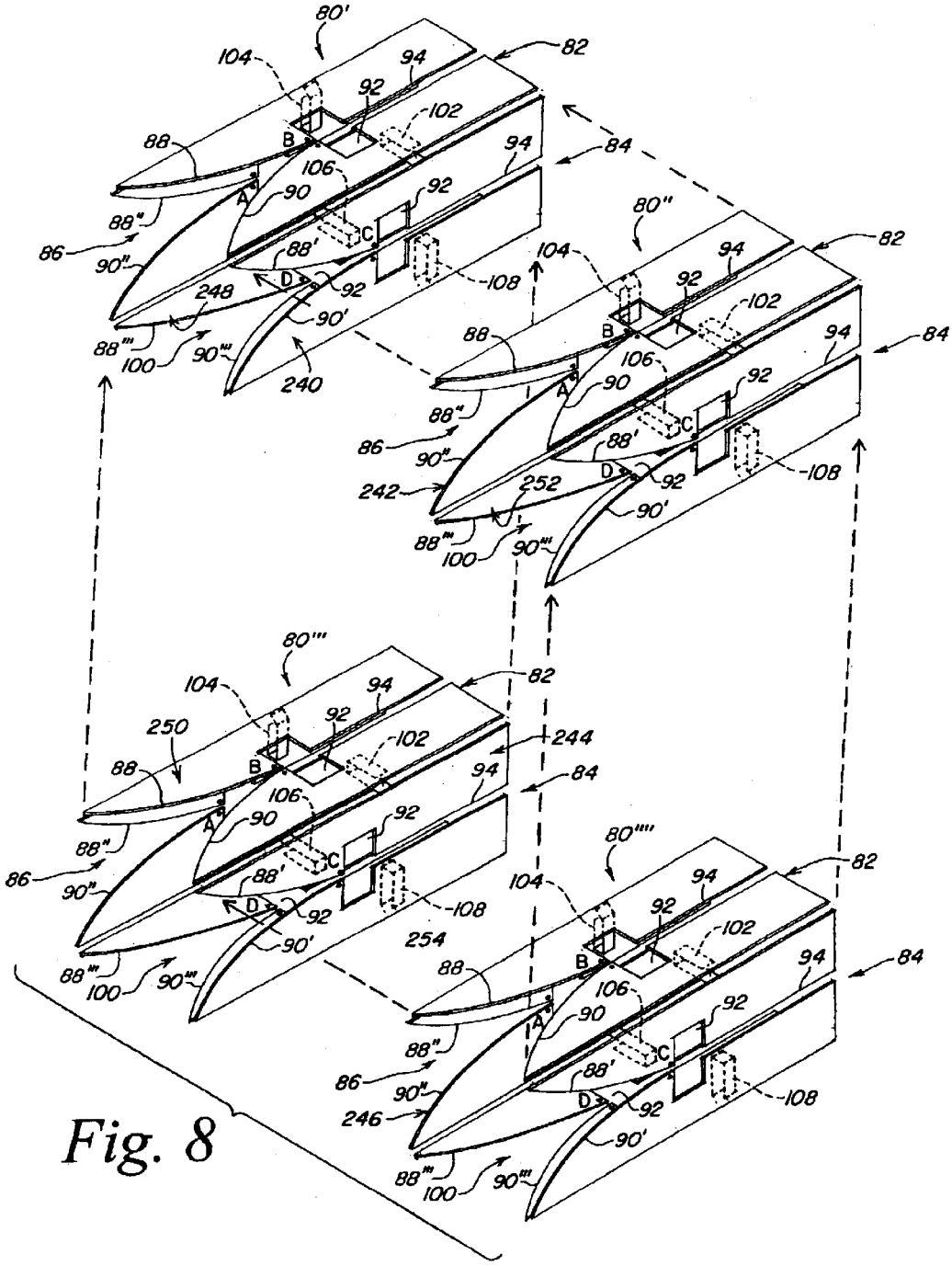
FIG. 8 is an exploded view of the concatenation of four antenna horns each having a top plate, opposed side plates, and a bottom plate, with the plates configured in a combined Vivaldi notch, meander line loaded antenna configuration.

Referring to FIG. 8, an array of elements such as that illustrated in FIG. 3A may be fabricated by concatenating the square horn shaped elements both in a horizontal and in a vertical direction. Here the upper left most element is designated 80', the upper right most element is designated 80", the lower left element is 80'", and the lower right 80"".

The plates which are shared between the elements are plates 243 and 245 for elements 80' and 80", and plates 244 and 246 for elements 80'", and 80"– for the horizontal concatenations.

For the vertical concatenations, plates 248 and 250 of elements 80' and 80'" are shared, whereas plates 252 and 254 are the shared plates between elements 80" and 80"".

The concatenation of the four horn antennas into a quad array provides four times the lineal length of antenna, and therefore even further decreases the low frequency cut-off of the array, to for instance, as little as 20 MHz, with the remainder array going up to 1.5 GHz without grating lobes, and beyond if grating lobes are tolerable.

Figure 9:
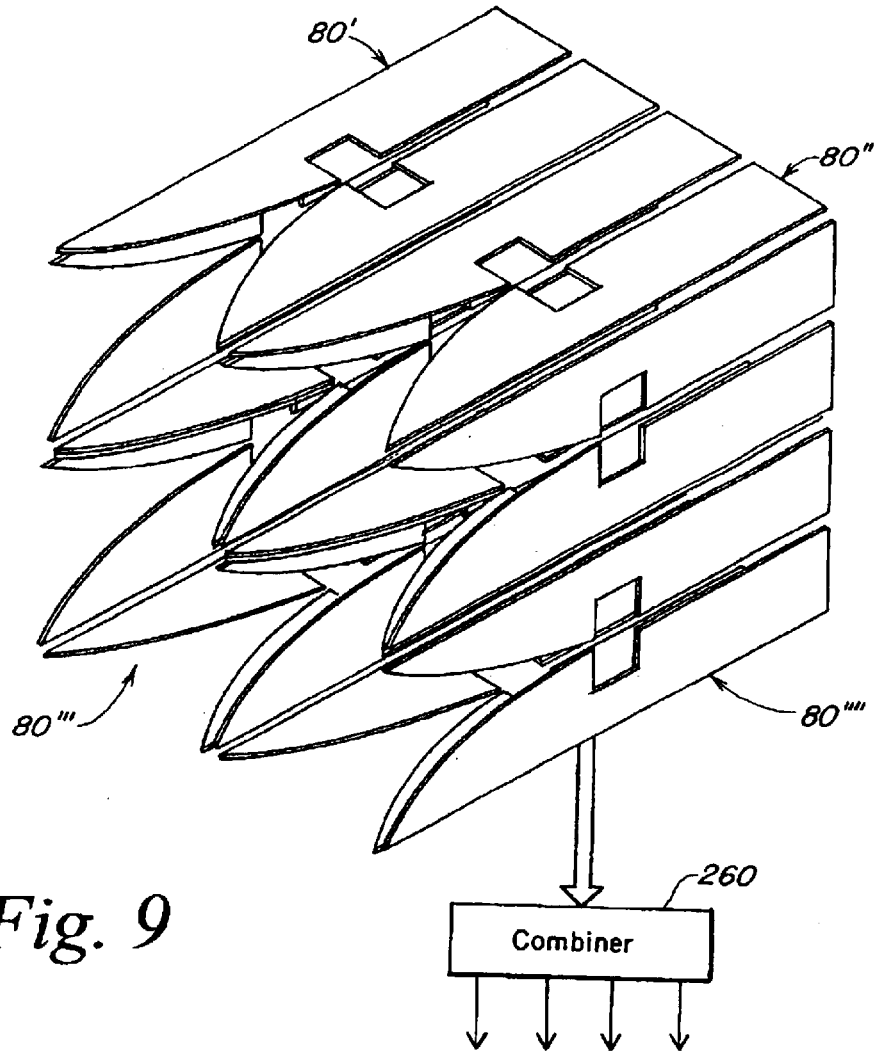
FIG. 9 is a diagrammatic representation of the concatenation of the horn elements of FIG. 8 into an array, with the array formed thereby coupled by a combiner.

Referring to FIG. 9, the array achieved by the concatenation of four Vivaldi notch/MLA horns, is illustrated in which the feed points of the various Vivaldi notch/meander line loaded antennas are coupled to a combiner 260, with combiner 260 combining the outputs of the twelve feed points involved.

Figure 10:
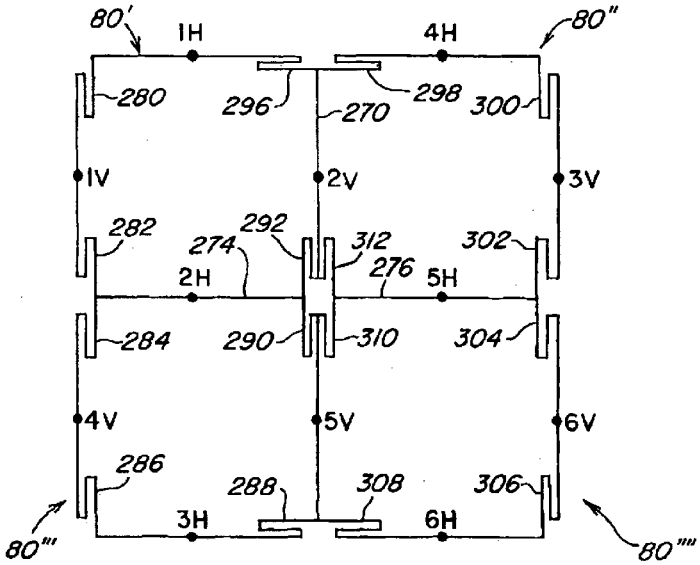
FIG. 10 is a cross-sectional diagrammatic illustration of the array of FIG. 9, illustrating the feed points for the various Vivaldi notch/MLA components of the array, denoting the feed points as 1H–6H and 1V–6V.

Referring to FIG. 10 in cross-section, the feed points for the concatenated array of FIG. 9 are labeled 1H, 2H, 3H, 4H, 5H, 6H, 1V, 2V, 3V, 4V, 5V, and 6V.

The shared plates for the concatenated antennas are illustrated at 270, 272, 274, and 276, with meander lines

280–312 being interposed between the respective plates of the various antenna elements.

Figure 11:
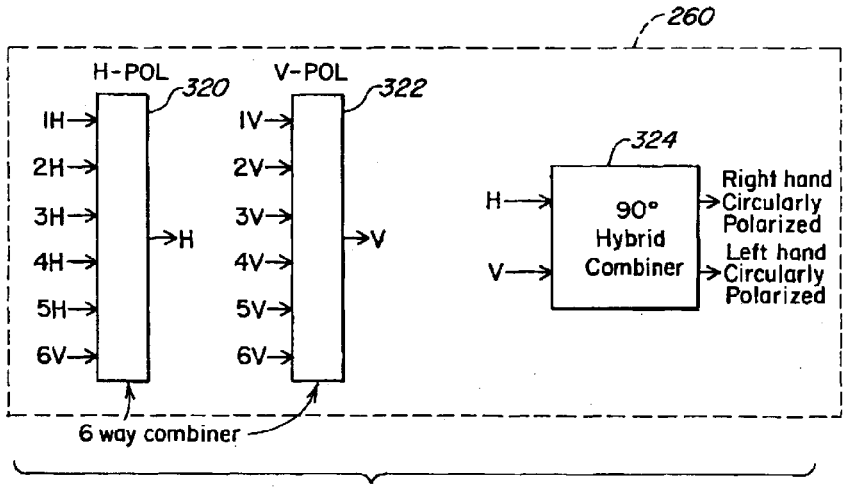
FIG. 11 is a diagrammatic illustration of the utilization of two six-way combiners and a 90° hybrid combiner to provide the array with a horizontal polarization, a vertical polarization, and both right hand and left hand circular polarizations.

Referring FIG. 11, combiner 260 may include a six-way horizontal polarity combiner 320, and a six-way vertical polarization combiner 322, the outputs of which are coupled to a 90° hybrid combiner 324.

The output of the horizontal polarity combiner is illustrated as H, whereas the output of the vertical polarization combiner 322 is illustrated as V. These outputs may be utilized independently to give the antenna array a horizontal or vertical polarization. Alternatively, right hand circular polarization and left hand circular polarization is available at the output of combiner 324, it being understood that the combiners are bidirectional, such that in the transmit mode, the desired transient polarization may be achieved.

Figure 12:
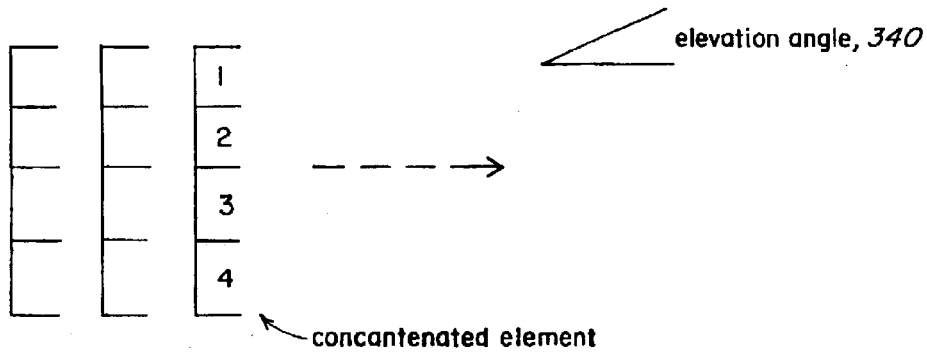
FIG. 12 is a diagrammatic illustration of four of the elements in a 12 element array, illustrating the control of the elevation angle through appropriate phasing of the feeds to these elements.
Figure 13:
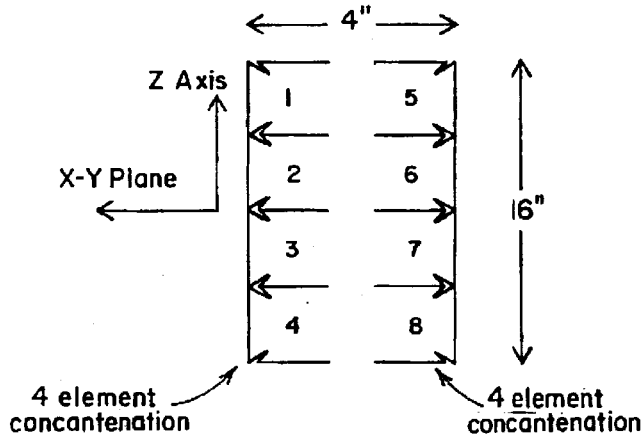
FIG. 13 is a diagrammatic illustration of a four element concatenation, illustrating the meander lines between the elements, also indicating the size of the combined elements in one embodiment; and, FIG. 14 is a series of antenna patterns measured for the array of FIG. 13, showing X-Y plane patterns at 50 MHz, 100 MHz, 200 MHz, 400 MHz, 800 MHz, and 1600 MHz.

Having described how the antenna may be phased, referring to FIG. 12, the concatenated elements, here illustrated at 1, 2, 3, and 4 can be provided with a major lobe that exits at an elevation angle 340, with the four element concatenations of FIG. 13 providing a single lobe given array dimensions of four inches by sixteen inches.

It will be appreciated that one has a circular lobe in the X-Y plane.

Figure 14:
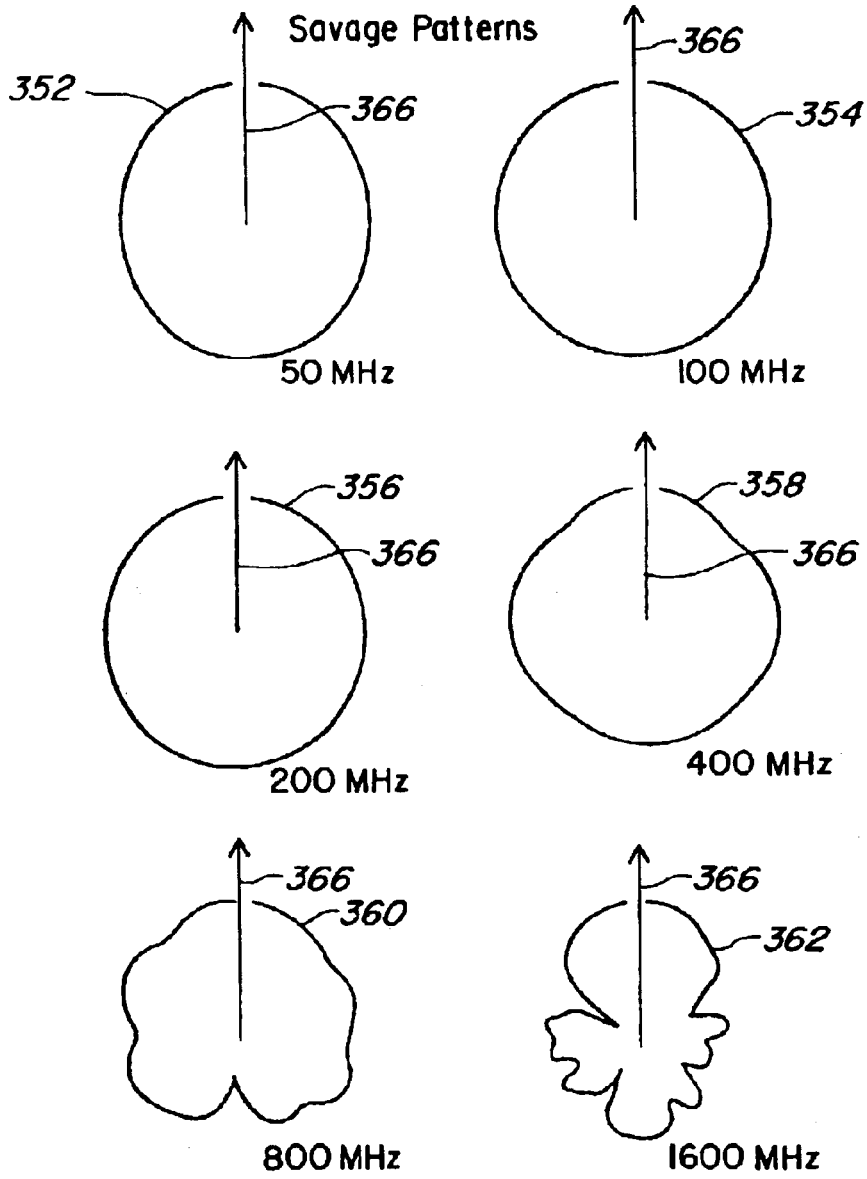

How this lobe varies with frequency is shown in FIG. 14, in which the array patterns are respectively 352 at 50 MHz, 354 at 100 MHz, 356 at 200 MHz, 358 at 400 MHz, 360 at 800 MHz, and 362 at 1600 MHz.

What can be seen is that in the X-Y horizontal azimuth plane for the array, the array pattern is close to circular at the lower frequencies, and has modified lobes in the end-fire direction illustrated by arrow 366, all the way up to through 1600 MHz.

While the subject invention has described concatenation in terms of the arraying of four horns together to provide the array, it will be appreciated that the concatenated array elements can be multiplied as desired for an array of any desired size. Thus while the quad configuration represents the process of arraying four Vivaldi notch/meander line loaded antenna elements, arrays of hundreds of such elements is within the scope of the subject invention.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. Apparatus for decreasing the low frequency cut-off of a combined Vivaldi notch/meander line loaded antenna, comprising:

an array of concatenated Vivaldi notch meander line loaded antenna elements, each of said elements having at least one plate coupled to an adjacent plate by a meander line, adjacent elements having adjacent plates electrically coupled together, whereby at low frequencies the adjacent antenna elements function as one larger element having a low cut-off frequency lower than that associated with the adjacent elements separately.

2. The apparatus of claim 1, wherein said adjacent plates have a single plate substituted therefor.

3. The apparatus of claim 1, wherein each of said plates includes therein a Vivaldi notch having a throat and a slot to the rear of said throat.

4. The apparatus of claim 3, wherein each of said plates has a cavity interposed between the throat and the slot therein.

5. The apparatus of claim 1, wherein two of said elements are concatenated, thus to decrease said low frequency cut-off by the increased size of the array over a single one of said elements.

6. The apparatus of claim 1, wherein four of said elements are concatenated.

7. The apparatus of claim 6, wherein the low frequency cut-off of said array is below 20 MHz.

8. The apparatus of claim 1, wherein each of said elements have an ultra wide bandwidth.

9. The apparatus of claim 8, wherein said array exhibits a single lobe end-fire pattern.

10. The apparatus of claim 9, wherein the high frequency cut-Off of said array is in excess of 1.5 GHz.

11. The apparatus of claim 9, wherein the high frequency cut-off is below that frequency at which grating lobes are unacceptable.

12. The apparatus of claim 9, wherein the high frequency cut-off is below that frequency at which grating lobes exist.

13. A method for reducing the low frequency cut-off of a combined Vivaldi notch/meander line loaded antenna comprising the step of:

concatenating a number of adjacent Vivaldi notch/meander line loaded antenna elements such that at low frequencies the elements act as one element.

14. The method of claim 13, wherein said concatenated elements form an array.

15. The method of claim 13, wherein the elements have plates and wherein the concatenation step includes providing that adjacent elements share a plate.

16. The method of claim 13, wherein the elements have plates and wherein the concatenation step includes the step of electrically connecting plates of adjacent elements.

17. The method of claim 13, wherein the elements have plates and wherein selected ones of said plates have therein a Vivaldi notch having a throat and a slot communicating with the notch and running aft of the notch.

18. The method of claim 17 and further including a cavity interposed between the notch and the slot.

19. The method of claim 17, wherein each of the plates have therein the Vivaldi notch and the slot.

20. The apparatus of claim 13, wherein the low frequency cut-off is below 20 MHz.

21. The method of claim 13 and further including the steps of providing the concatenated elements which a selectable polarity characteristic.

22. The method of claim 21 wherein the polarity characteristic is selected from the group consisting of horizontal, vertical, left hand circularly polarized and right hand circularly polarized polarities.

23. The method of claim 14, wherein the array is steerable.

24. The method of claim 13, wherein at the higher frequencies each of the concatenated elements operates independently.

25. The method of claim 22, wherein at the higher frequencies there is significant isolation between horizontal and vertical polarization.

* * * * *